United States Patent [19]

Kindscher et al.

[11] 3,985,504

[45] Oct. 12, 1976

[54] ANTICORROSIVE AGENT

[75] Inventors: Wolfgang Kindscher, Fussgoenheim; Knut Oppenlaender, Ludwigshafen, both of Germany

[73] Assignee: BASF Aktiengesellschaft, Ludwigshafen (Rhine), Germany

[22] Filed: Nov. 15, 1975

[21] Appl. No.: 524,048

[30] Foreign Application Priority Data

Nov. 21, 1973 Germany ..... 2357951

[52] U.S. Cl. ..... 21/2.7 R; 21/2.5 R; 252/392; 252/396; 252/312; 208/47

[51] Int. Cl.[2] ..... C23F 11/14; C23F 11/12

[58] Field of Search ..... 252/392, 396, 312; 21/2.7 R, 2.5 R; 260/404.8; 208/47

[56] References Cited

UNITED STATES PATENTS

| | | | |
|---|---|---|---|
| 2,188,882 | 1/1940 | Clocker | 260/404 |
| 2,188,883 | 1/1940 | Clocker | 260/404.8 |
| 2,188,884 | 1/1940 | Clocker | 260/404.8 |
| 2,188,885 | 1/1940 | Clocker | 260/404.8 |
| 2,188,886 | 1/1940 | Clocker | 260/404.8 |
| 2,188,887 | 1/1940 | Clocker | 260/404.8 |
| 2,188,888 | 1/1940 | Clocker | 260/404.8 |
| 3,382,056 | 5/1968 | Mahmadbasich | 252/396 |
| 3,412,111 | 11/1968 | Irwin et al. | 252/396 |
| 3,447,918 | 6/1969 | Amick | 252/396 |

*Primary Examiner*—Benjamin R. Padgett
*Assistant Examiner*—Irwin Gluck
*Attorney, Agent, or Firm*—Johnston, Keil, Thompson & Shurtleff

[57] ABSTRACT

Anticorrosive agent based on saponified ene-adducts of maleic anhydride to unsaturated fatty acids or derivatives thereof.

8 Claims, No Drawings

ANTICORROSIVE AGENT

This application discloses and claims subject matter described in German patent application No. P 23 57 951.3, filed Nov. 21, 1973, which is incorporated herein by reference.

This invention relates to novel anticorrosive agents in aqueous media.

In numerous applications in which iron and other iron-containing metals such as steel come into contact with water or inorganic/aqueous or organic/aqueous solutions, aqueous emulsions of the oil-in-water type or aqueous dispersions of solid matter and other systems containing an appreciable amount of water, there is the risk of corrosion.

In most cases, the corrosive action of the particular aqueous medium on the machine parts, parts of apparatus, tanks and pipes and other structural elements of iron, iron alloys or steel must be reduced or suppressed by anticorrosive additives. The corrosive properties are frequently reduced to a certain extent merely by adjusting the aqueous medium to a relatively strong alkaline pH, for example by the addition of alkali metal hydroxides, alkali-reacting salts such as soda, borax, alkali metal phosphates, or by the addition of organic bases such as mono-, di- and tri-ethanolamines and other aliphatic, aromatic, cycloaliphatic and heterocyclic amines.

However, using this method, no appreciable reduction in the corrosive action of the aqueous medium is achieved until pH's of more than 9.5–10 are reached. In many cases, the effect is by no means sufficient, particularly when it is desired to achieve long-term passivation of the metal surface following contact with the aqueous medium.

In suitable cases, real passivation is achieved by the addition of oxidizing inorganic salts such as sodium nitrite or sodium chromate or by adding nitric acid itself, but it is nowadays seldom possible to make full use of this possibility on account of the toxicity of the substances and in view of effluent legislation. Moreover, this film-forming passivation is seldom compatible with the above applications. However, a film-forming passivation by means of suitable organic compounds, which in the neutral to relatively strongly alkaline pH range of interest in the present case usually have an anionic and possibly a non-ionic or at most weakly cationic character, is generally applicable.

Examples of the anionic type of substance are alkali metal or amine salts of straight-chain aliphatic, saturated and unsaturated carboxylic acids, of which the salts of oleic acid have become particularly significant. Furthermore, the salts of aliphatic carboxylic acids containing carbonamide or sulfonamide groups, e.g. the salts of oleoyl sarcoside or the alkanesulfonamide carboxylic acids have been known for many years to be very effective anticorrosive agents for aqueous media to effect protection of iron and steel. Recently, as disclosed for example in German published application No. 1,298,672, attention has been paid to aralkylsulfonamide carboxylic acids and salts thereof and also to simple alkyl-substituted benzoic acids or alkylarylsulfonic acids, as generally known for a number of years.

However, the above types of substance have serious disadvantages. Fatty acid salts, of which the salts of oleic acid have been given particular attention, are sensitive, to a certain extent, to water hardness, and this greatly reduces their anticorrosive protection of iron and steel, which is in any case inadequate for stringent requirements. The products containing carbonamide groups, such as the oleoyl sarcasides, are less sensitive to water hardness but show a tendency to foam which is difficult to control, and this restricts their use. The aforementioned sulfur-containing compounds can undergo bacterial decomposition to foul-smelling volatile sulfur compounds such as hydrogen sulfide and mercaptans. Thus, with continued use of these compounds, their anticorrosive action diminishes relatively quickly.

The non-ionic or weakly cationic anticorrosive substances which have been generally known for many years but which have no longer been specifically mentioned in recent patent specifications are, in particular, the alkylolamides of aliphatic carboxylic acids and their alkylolamine esters such as oleic monoethanolamide, oleic diethanolamide and oleic mono- and diisopropanolamides.

Compounds having a weakly cationic character are the fatty acid esters of triethanolamine or of triisopropanolamine, these also having been well known in this field for many years. However, compounds in these classes are only sparingly soluble in water and thus can only be used either in conjunction with the aforementioned anionic anticorrosive substances or only in the oil phase of aqueous emulsions, in which case they act as anticorrosive emulsifying components.

It is an object of the invention to provide water-soluble corrosion inhibitors showing as broad a range of activity and applications as possible and, in particular, not exhibiting the above drawbacks.

We have found that saponified ene-adducts of maleic anhydride to an unsaturated fatty acid of from 12 to 24 carbon atoms and containing at least one olefinic double bond, their esters or amides exhibit maximum anticorrosive activity for the protection of iron or iron-containing metals.

These ene-adducts are well known. They are obtained as described by A. E. Rheineck and T. H. Khoe in "Fette, Seifen, Anstrichmittel" No. 8, pp. 644–652 (1969) or in U.S. Pat. Nos. 2,188,882 to 2,188,890, by simple thermal addition of maleic anhydride to an aliphatic carboxylic acid containing an unsaturated double bond followed by saponification of the anhydride group with bases. The unsaturated double bond of the maleic anhydride splits open and addition occurs at the site adjacent the double bond of the carboxylic acid. Discussions on the chemistry of this reaction are contained, for example, in the cited references.

We prefer to use those adducts which are formed from 0.8 to 1.2 moles of saturated aliphatic carboxylic acid and from 0.8 to 1.2 moles of maleic anhydride, followed by saponification of the anhydride grouping and partial or complete neutralization with the said bases. Suitable bases for neutralization in the present invention are, in addition to the well-known inorganic alkalis such as sodium and potassium hydroxides or $NH_3$, particularly organic amides such as trimethylamine, triethylamine, triisopropylamine and triisobutylamine and, of particular significance industrially, alkanolamines such as triethanolamine and triisopropanolamine.

Unsaturated carboxylic acids which may serve as starting products for the thermal adduct formation are, for the purposes of the invention, those having from 12 to 24 carbon atoms, particular examples being palmitoleic acid, fatty acids of coconut, palm-kernel and tall oil, oleic acid, elaidic acid, ricinoleic acid, linoleic acid, linolenic acid, linseed oil fatty acid, train oil fatty acid, cottonseed oil fatty acid, peanut oil fatty acid, erucic acid and mixtures of said fatty acids.

Furthermore, fatty acid derivatives used in a particularly preferred embodiment of the invention are those which have been produced by esterification or amidation of said fatty acids. Examples of such compounds are oleoyl sarcoside and the corresponding sarcosides of the above unsaturated aliphatic carboxylic acids, these having been used (some years ago) alone as anticorrosive agents, as mentioned above. Also suitable are esters of said fatty acids, e.g. esters with aliphatic hydroxycarboxylic acids such as glycolic acid, lactic acid, β-hydroxypropionic acid and β-hydroxybutyric acid.

The condensation reaction between the said unsaturated carboxylic acids or their amides or esters and maleic anhydride gives, as mentioned above, ene-adducts containing anhydride groupings which, on subsequent saponification, provide unsaturated dioic or trioic acids. The anticorrosive agents of the invention are then obtained in a simple manner by neutralization of said acids with the aforementioned organic or inorganic bases.

The ene-adducts are excellent anticorrosive agents in water-containing or aqueous liquids coming into contact with iron or metals containing iron. Examples of such liquids are water itself, inorganic or organic aqueous solutions, aqueous emulsions of the oil-in-water type or aqueous dispersions of solid matter, for example refrigerating liquids, hydraulic liquids, mineral oil-free, water-containing metal machining liquids, metal machining emulsions, drilling oils, grinding and polishing emulsions or dispersions and metal cleaners of various kinds. Further examples are anticorrosive surface-treating agents such as anticorrosive emulsions and passivating solutions based on water. Further examples are process waters occurring in the chemical industry and other branches of industry in which there is contact with iron and steel.

The amounts in which the anticorrosive agents are added depend on the type of liquid with which the iron or iron-containing metal comes into contact.

Depending on the application, from 0.5 to 5.0% by weight and in some cases more of the ene-adducts proposed by the invention is used, based on the weight of the liquid medium to be treated. The optimum action is achieved at pH's above 7.5 and preferably from 7.5 to 8.5, the optimum amount used being from 0.5 to 2% by weight.

In the following Example the parts are by weight unless otherwise stated.

EXAMPLE 1

I: 3,600 parts (12.75 molar portions) of oleic acid and 1,080 parts (11 molar portions) of maleic anhydride are brought together under nitrogen and slowly heated to 180° C and then stirred for 3 hours at 180° C. The reaction product has an acid number of approx. 290.

II: 4,000 parts of product I and 4,100 parts of water are together placed in a stirred vessel and to this mixture are added, at from 80° to 90° C, 3,600 parts of triethanolamine. The pH is adjusted to 7. The triethanolamine salt of the resulting trioic acid is present in a concentration of 65% in water.

EXAMPLE 2

I: 3,180 parts (11 molar portions) of tall oil fatty acid are placed in a stirred vessel under nitrogen at from 80° to 90° C. There are then added 1,078 parts (11 molar portions) of maleic anhydride in powder form. The mixture is slowly heated to 200° C and stirred at that temperature for 2 hours.

II: 3,600 parts (11 molar portions) of product I are mixed with 3,870 parts of water and reacted, at from 80° to 90° C, with 3,600 parts of triethanolamine. The pH is adjusted to 7. The triethanolamine salt of the resulting trioic acid is present in a concentration of 65% in water.

TESTS ON PRODUCTS OF THE INVENTION a. Herbert corrosion test

The anticorrosive action is illustrated in an aqueous solution containing 1% of active ingredient and exhibiting a water hardness of 10° DH by the use of the Herbert test system adopted in the metal-processing industries. This system consists of a standardized gray cast iron plate and similarly standardized steel turnings having a length of 5 mm and sold by Alfred Herbert, Coventry, England. The square plate measuring 100 × 100 × 5 mm is abraded thoroughly clean with a belt grinder using a corundum emery belt grade 120, washed with white spirit and ethanol and dried with a clean cloth, prior to testing. The steel turnings included in the test system and produced under standardized conditions from 0.40% carbon steel are then placed in four heaps on the prepared plate of cast steel by means of a suitable metal or plastic spoon having the capacity of a normal teaspoon, these heaps being positioned so as to be equidistant from each other and from the edges of the plate. The turnings should be as close together as possible in a single layer.

The solutions or emulsions to be tested for anticorrosive properties are applied dropwise to the heaps of turnings by means of a graduated pipette, the amount poured onto each heap being just sufficient to be held back from spreading by the turnings. After standing for 24 hours in an atmosphere of 70% relative humidity, the turnings are shaken from the plate by tipping. The contour of the dried aqueous medium is distinctly visible. At the points of contact between the turnings and the plate rust marks are visible, the extent of which depends on the corrosive properties of the liquid, and these rust marks may even form a continuous layer of rust. Assessment may be effected visually determining the percentage of the area covered by rust.

b. Gray cast iron filter test

Another corrosion test is the gray cast iron filter test. Use is made of a Petri dish having an internal diameter of about 10 cm and a lid to fit. A round filter is placed in the Petri dish. Using a suitable spoon, from 5 to 10 grams of coarse turnings of gray cast iron GG 20 are distributed in such a manner that a uniform heap is formed in the center of the filter at a distance of about 1.5 cm from the edge thereof all around. The turnings have a length of from about 5 to 8 mm and must be made from clean gray cast iron GG 20 without the use of drilling oil or other cooling lubricants. All fine particles must be sifted out.

A graduated pipette is used to apply 5 ml of the solution or emulsion to be tested for corrosive properties to the heap of turnings. The pH of the test liquid is registered, as it is very important for assessment. It may be set at a standard value, e.g. 8.5. After moistening of the turnings, the liquid is placed on the dish and the whole is allowed to stand for 2 hours under normal laboratory conditions, i.e. from 23° to 25° C and at about 70% relative humidity. The lid is then removed and the filter is placed downwardly on the surface of a volume of tap water to remove the turnings. It is then immediately sprayed and impregnated with an indicator solution of the following composition:

1 g of potassium hexacyano ferrate (III)
30 g of common salt
1 l of water.

The indicator is then allowed to act for 17 seconds in air. The filter is then carefully rinsed in running drinking water and dried in air in a moderately warm place. Following this procedure, spots are to be seen on the filter paper, these being of an intensity and color depending on the corrosive properties of the medium, the colors being brownish yellow, yellow and/or bluish green, the brownish yellow or yellow colors being the least desirable from the point of view of the test. Non-corrosive properties are indicated by complete absence of brown or yellow coloration and at most traces of pale bluish green spots. The filters are completely color-stable and may therefore be used for documentation purposes. A scale of values may be construed as follows:

very poor: large spots of strong color, mainly yellowish brown;
poor: large spots of strong color showing approximately equal proportions of yellowish brown and bluish green;
moderate: paler spots of medium size showing approximately equal proportions of yellow and bluish green;
good: very pale spots of a mainly bluish green color and of pin-head size;
very good: no spots or at most very few and very small pale bluish green spots.

c. Foaming behavior

The foaming behavior may be tested according to DIN 53,902 "Determination of foaming power and foam stability". The simplified testing procedure is sufficient, the plunger with the perforated plate being moved steadily up and down 30 times in 30 seconds by hand and then carefully removed (IG beating method). The volume of foam is read from the graduated foam cylinder after 1, 5 and 10 minutes and is given in ml. Other important factors are the temperature, concentration and water hardness.

The following products were compared with each other to illustrate the activity differences in the test methods described above:

1. triethanolamine oleate,
2. triethanolamine salt of oleoyl sarcoside,
3. the sodium salt of $C_{13}$-15 alkanesulfonamidoacetic acid,
4. triethanolamine salt of phenylsulfonylaminocapronic acid
5. triethanolamine salt of the oleic acid/maleic anhydride adduct of Example 1,
6. triethanolamine salt of the tall oil acid/maleic anhydride adduct of Example 2.

The test results are listed in the Table below.

It is seen that the agents of the invention have very low foaming properties and show good grading in the Herbert test and in the gray cast iron filter test, which grading is superior to that of the other agents. It must be mentioned that the gray cast iron/filter test generally gives a more sensitive indication and that the interpretations of the two tests do not always confirm each other. However, where a product shows good to very good behavior in both tests, this usually signifies good properties in industrial use. The fourth column indicates the anticorrosive properties of each product at the lowest concentration (5 g/l) when the pH is artificially adjusted to 8.5. The other tests make use of the solution at its natural, i.e. unadjusted, pH.

TABLE

| | | Anticorrosive properties at 25°C using water of a hardness of 10°DH | | | Foaming properties (25°C, 2 g/l, 10°DH) (ml of foam) | | |
|---|---|---|---|---|---|---|---|
| Product No. | pH | conc. (g/l) | (a) Herbert test (% of area covered by rust) | (b) gray cast iron/filter test | 1 min. | 5 min. | 10 min. |
| 1 | 8.0 | 5 | 80 | poor | 120 | 90 | 60 |
| | 8.2 | 10 | 10 | mod. | | | |
| | 8.3 | 20 | 0 | good | | | |
| | 8.5 | 5 | 0 | good | | | |
| 2 | 7.7 | 5 | 50 | good | 40 | 20 | 10 |
| | 8.0 | 10 | 50 | good | | | |
| | 7.6 | 20 | 1 | very good | | | |
| | 8.5 | 5 | 0 | good | | | |
| 3 | 7.6 | 5 | 0 | poor | 20 | 10 | 5 |
| | 7.8 | 10 | 0 | mod. | | | |
| | 8.0 | 20 | 5 | good | | | |
| | 8.5 | 5 | 0 | mod. | | | |
| 4 | 8.6 | 5 | 20 | poor | 30 | 20 | 10 |
| | 8.8 | 10 | 1 | good | | | |
| | 9.1 | 20 | 0 | very good | | | |
| | 8.5 | 5 | 0 | poor | | | |
| 5 | 7.3 | 5 | 50 | mod. | 0 | 0 | 0 |
| | 7.7 | 10 | 20 | good | | | |
| | 7.7 | 20 | 0 | very good | | | |
| | 8.5 | 5 | 0 | very good | | | |
| 6 | 7.5 | 5 | 0 | good | 0 | 0 | 0 |
| | 7.7 | 10 | 0 | good | | | |
| | 8.0 | 20 | 0 | very good | | | |
| | 8.5 | 5 | 0 | very good | | | |

We claim:

1. A method of preventing corrosion of iron or iron-containing metals under circumstances in which said metals come into contact with water or liquid containing an appreciable amount of water under corrosion inducing conditions which comprises: incorporating into said water or water-containing liquid a corrosion inhibiting amount of alkali-saponified ene-adducts of maleic anhydride on at least one unsaturated fatty acid of from 12 to 24 carbon atoms and containing one olefin double bond, their esters or their amides, said corrosion inhibiting amount of said alkali-saponified ene-adducts being from 0.5 to 5% by weight, based on said liquid.

2. A method as set forth in claim 1 wherein ene-adducts are used which are saponified with sodium hydroxide, potassium hydroxide, trimethylamine, triethylamine, triisopropylamine, triisobutylamine, triethanolamine or triisopropanolamine.

3. A method as set forth in claim 1 wherein saponified ene-adducts of maleic anhydride to palmitoleic acid, coconut fatty acid, palm kernel fatty acid, tall oil fatty acid, oleic acid, elaidic acid, ricinoleic acid, train oil fatty facid, cottonseed oil fatty acid, peanut oil fatty acid, erucic acid and mixtures of said fatty acids are used.

4. A method as set forth in claim 1 wherein saponified ene-adducts of maleic anhydride to sarcosides of unsaturated fatty acids are used.

5. A method as set forth in claim 1 wherein liquids selected from the group consisting of water, inorganic or organic aqueous solutions, aqueous emulsions of the oil-in-water type or aqueous dispersions of solid matter are used.

6. A method as set forth in claim 1 wherein the pH of the water or water-containing liquid is about 7.5.

7. A method as set forth in claim 1 wherein the pH of the water or water-containing liquid is about 7.5 to 8.5.

8. A method as set forth in claim 7 wherein the amount of said alkali-saponified ene-adduct is from 0.5 to 2% by weight.

* * * * *